US011432632B2

(12) United States Patent
Matias et al.

(10) Patent No.: US 11,432,632 B2
(45) Date of Patent: Sep. 6, 2022

(54) METHOD AND DEVICE FOR SEALING OF VERTICAL HAIRSTYLE

(71) Applicants: Natara Matias, Bronx, NY (US); Angelina Perez, Bronx, NY (US)

(72) Inventors: Natara Matias, Bronx, NY (US); Angelina Perez, Bronx, NY (US)

( * ) Notice: Subject to any disclaimer, the term of this patent is extended or adjusted under 35 U.S.C. 154(b) by 0 days.

(21) Appl. No.: 17/548,552

(22) Filed: Dec. 12, 2021

(65) Prior Publication Data

US 2022/0095760 A1 Mar. 31, 2022

(51) Int. Cl.

| | |
|---|---|
| ***A45D 7/02*** | (2006.01) |
| ***A45D 2/00*** | (2006.01) |
| *A45D 19/00* | (2006.01) |

(52) U.S. Cl.

CPC ..... *A45D 2/001* (2013.01); *A45D 7/02* (2013.01); *A45D 19/0041* (2021.01); *A45D 19/0066* (2021.01)

(58) Field of Classification Search

CPC ... A45D 7/02; A45D 7/06; A45D 7/00; A45D 2002/003; A45D 19/0041; A45D 19/012; A45D 19/16; A45F 2003/205; A45F 2019/2277; A45F 19/2288

USPC ..... 132/202–208, 212, 272, 200, 271

See application file for complete search history.

(56) References Cited

U.S. PATENT DOCUMENTS

| | | | | |
|---|---|---|---|---|
| 3,805,810 | A * | 4/1974 | Savala | A45D 7/04 132/270 |
| 5,704,503 | A | 1/1998 | Krishnakumar et al. | |
| 6,454,127 | B1 * | 9/2002 | Suomela | B67D 7/80 222/638 |
| 8,053,009 | B2 | 11/2011 | Bourguignon et al. | |
| 8,087,525 | B2 | 1/2012 | Kelley et al. | |
| 8,308,006 | B2 | 11/2012 | Nievierowski et al. | |
| 2004/0195199 | A1 | 10/2004 | Maki et al. | |
| 2010/0237036 | A1 | 9/2010 | Trude | |
| 2011/0030715 | A1 * | 2/2011 | Spooner | A45D 44/00 132/212 |
| 2011/0290753 | A1 * | 12/2011 | Tuan | A47G 19/12 215/382 |
| 2014/0331416 | A1 | 11/2014 | Akinbobola et al. | |
| 2015/0027481 | A1 * | 1/2015 | Jobita | A45D 2/00 132/271 |
| 2015/0203236 | A1 | 7/2015 | Etesse | |
| 2016/0031596 | A1 * | 2/2016 | Tuan | A47J 27/2105 219/438 |
| 2018/0213917 | A1 * | 8/2018 | Greene | A45D 8/34 |
| 2020/0023284 | A1 * | 1/2020 | Choi | D02G 1/02 |

(Continued)

FOREIGN PATENT DOCUMENTS

| | | | | |
|---|---|---|---|---|
| CN | 110638654 A * | 1/2020 | | A45F 3/20 |
| WO | WO-2007100062 A1 * | 9/2007 | | A45D 19/0008 |

*Primary Examiner* — Tatiana L Nobrega

(74) *Attorney, Agent, or Firm* — Michael J. Feigin, Esq.; Feigin and Fridman LLC

(57) ABSTRACT

A device for sealing a vertical hairstyle including synthetic strands. The device includes a chamber having a heating mechanism disposed in a bottom surface of the chamber. The device further includes a neck portion defining a portal into the device. The neck portion is at least partially lined with a liquid-absorbent material. An extendable portion is disposed between, and connects, the chamber and the neck portion. The extendable portion is extendable between a fully compressed state and a fully extended state.

7 Claims, 6 Drawing Sheets

(56) References Cited

U.S. PATENT DOCUMENTS

2021/0120932 A1* 4/2021 Han ..... A45D 4/04
2021/0337954 A1* 11/2021 Greene ..... A45D 7/00

* cited by examiner

METHOD AND DEVICE FOR SEALING OF VERTICAL HAIRSTYLE

FIELD OF THE DISCLOSED TECHNOLOGY

The disclosed technology relates generally to methods and devices for hair care and, more specifically, to a method and a device for sealing box braids, twists, and other vertical hairstyles, particularly when the hairstyles include synthetic or artificial hair.

BACKGROUND OF THE DISCLOSED TECHNOLOGY

Hairstyles using synthetic or artificial hair often require sealing using heat, in order to soften the braids or twists and the artificial hair thereof. This is typically accomplished using hot water, where the braid (or other hairstyle component) is placed in a container of hot water, disposed beneath the person's head, for a short duration. Following exposure to the hot water, the braid is dabbed on a towel or other material to remove excess water drips, and is then held by a stylist, or second person, until the braid is cooled. This process typically involves multiple stylists—a first to insert the braid into the hot water, a second to dry the braid and prevent hot water from dripping, and often a third stylist to cool the braid, by holding and/or fanning of the braid.

During sealing of the braid, the patron whose hair is being sealed, as well as the hairstylists involved, are exposed to hot water and steam emanating therefrom, and to the heated braid. This can result in burns and other types of injuries. Additionally, the extent to which the braid can be inserted into the water is dependent on the patron's resistance to heat near their scalp. Furthermore, hot water can easily spill from open containers.

Thus, there exists a need in the art for a device and a method or sealing braids, twists, and other vertical hairstyles including synthetic hair which maximizes the efficiency of the braid sealing, such as the circumference of the braid sealed and the number of braids sealed at once, while reducing the risk of injury to the patron and the hairstylists, and allowing sealing of such braids by a single person.

SUMMARY OF THE DISCLOSED TECHNOLOGY

The disclosed technology relates generally to methods and devices for hair care and, more specifically, to a method and a device for sealing box braids, twists, and other vertical hairstyles, particularly when the hairstyles include synthetic or artificial hair.

According to an aspect of some embodiments of the teachings herein, there is provided a device for sealing a vertical hairstyle, which may include synthetic strands and/or natural human hair strands. The device includes a chamber having a heating mechanism disposed in a bottom surface of the chamber. The device further includes a neck portion defining a portal into the device. The neck portion is at least partially lined with a liquid-absorbent material. An extendable portion is disposed between, and connects, the chamber and the neck portion. The extendable portion is extendable between a fully compressed state and a fully extended state.

In some embodiments, the neck portion and the chamber are formed of a flexible material.

In some embodiments, the neck portion and the chamber are formed of a material having poor heat conductivity, such that an exterior surface of the neck portion and the chamber remains cool to the touch of a human hand when the chamber is filled with boiling water.

In some embodiments, the heating mechanism is adapted to heat a liquid disposed in the chamber, and is adapted to draw power from a power plate, when the device is disposed on the power plate.

In some embodiments, the device further includes an extendable handle, the extendable handle including a first segment connected to the chamber, a second segment connected to the neck portion, and an extendable handle segment connecting the first segment and the second segment, the extendable handle segment adapted to be extendable in accordance with extension of the extendable portion. In some such embodiments, the extendable handle segment comprises a plurality of telescoping segments.

In some embodiments, the device further includes a closure mechanism extending radially inwardly from the neck portion, wherein the closure mechanism has an open state allowing fluid flow between the neck portion and the extendable portion, and a close state preventing fluid flow between the neck portion and the extendable portion. In some such embodiments, the device further includes a lever, which, when activated by a user, transitions the closure mechanism from the open state to the closed state.

According to an aspect of some embodiments of the teachings herein, there is provided a system for sealing a vertical hairstyle including synthetic hair strands, the system including a device according to the disclosed technology and a power plate adapted to provide power to the heating mechanism when the device is disposed on the power plate, so as to heat water disposed in the chamber.

According to an aspect of some embodiments of the teachings herein, there is provided a method of sealing a vertical hairstyle including synthetic strands using the device of the disclosed technology, the method including inserting a liquid into the chamber via the portal, and heating the liquid in the chamber using the heating mechanism. The vertical hairstyle is placed into the device, via the portal, and the device is squeezed, to spread the heated liquid along the length of the vertical hairstyle.

According to an aspect of some embodiments of the teachings herein, there is provided a method of softening and straightening braids using the device of the disclosed technology, the method including inserting a liquid into the chamber via the portal, and heating the liquid in the chamber using the heating mechanism. The vertical hairstyle is placed into the device, via the portal, and the device is squeezed, to spread the heated liquid along the length of the braids, and drying the braids, thereby softening the braids and achieving a straighter texture of hair forming the braids.

According to an aspect of some embodiments of the teachings herein, there is provided a method of sanitizing a tool using the device of the disclosed technology, the method including inserting a liquid into the chamber via the portal, and heating the liquid in the chamber using the heating mechanism. The tool is placed into the device, via the portal, and the device is squeezed, to spread the heated liquid along the length of the tool, thereby to sanitize the tool.

According to an aspect of some embodiments of the teachings herein, there is provided a method of sealing a vertical hairstyle. The method includes inserting a liquid, such as water, into a chamber via a portal associated with the chamber, wherein the chamber is formed of a flexible material. The liquid disposed in the chamber is then heated, and the vertical hairstyle is placed into the chamber, via the portal. The chamber is then squeezed to spread the heated liquid along the length of the vertical hairstyle, thereby to seal the vertical hairstyle.

In some embodiments, the chamber is formed of a material having poor heat conductivity, and the method further includes holding an exterior of the chamber, during or immediately following the heating of the liquid disposed therein.

In some embodiments, the method further includes, prior to the heating of the liquid, placing the chamber on a power plate, and the heating comprises heating the fluid by a heating mechanism disposed at a base of the chamber, the heating mechanism drawing power from the power plate.

In some embodiments, an extendable portion is disposed between the portal and the chamber, and the method further includes, prior to the squeezing, extending the extendable portion to enclose the majority of the vertical hairstyle. In some such embodiments, the chamber is associated with an extendable handle, and the extending of the extendable portion further includes correspondingly extending the extendable handle.

In some embodiments, the portal forms part of a neck portion associated with the chamber, the neck portion being lined with an absorbent material, and the method further includes, following the squeezing, removing the vertical hairstyle from the chamber via the neck portion and the portal, and, during the removing, squeezing the neck portion to engage the absorbent material to the vertical hairstyle so as to absorb excess fluid from the vertical hairstyle.

In some embodiments, the method further includes, following the placing of the vertical hairstyle and prior to the squeezing, closing the portal associated with the chamber. In some such embodiments, the closing includes preventing heated fluid and steam from exiting the chamber during squeezing of the chamber.

In some embodiments, the liquid comprises a hair dye, and the method results in dyeing of human hair weaves in the vertical hairstyle.

In the context of the present application, the terms "braid" and "vertical hairstyle" are used interchangeably, and are defined as a box braid, twist, or any other hairstyle which includes longitudinal strands forming an interwoven structure.

DETAILED DESCRIPTION OF EMBODIMENTS OF THE DISCLOSED TECHNOLOGY

In an embodiment of the disclosed technology, a hair-sealing device includes a chamber for receiving water, and a longitudinally expandable portion. Water is poured into the chamber, and is then heated on a suitable base. Following heating of the water, the braid is inserted in to the water, and the portal of the device is closed. The expandable portion of the chamber is then expanded to spread the water along the braid. An upper neck portion of the hair-sealing device includes an absorbent material that clamps around the braid as the braid is being removed from the device, absorbing excess water from the braid and cooling the braid as it is removed.

According to an aspect of some embodiments of the teachings herein, there is provided a PARAPHRASE INDEPENDENT CLAIMS Embodiments of the disclosed technology will become clearer in view of the following description of the drawings.

Figure 1A:
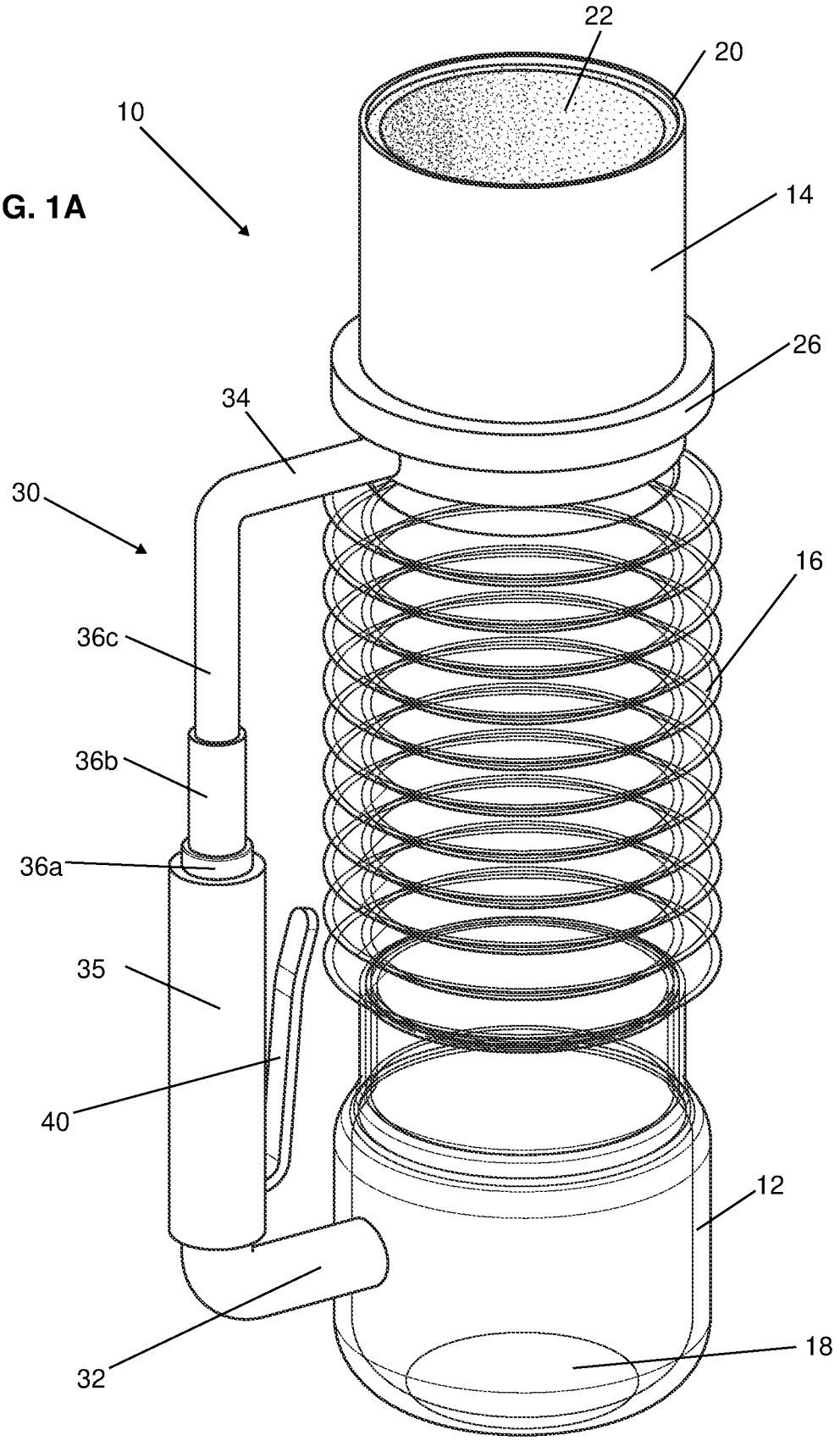
FIGS. 1A and 1B are perspective illustrations of a braid-sealing device according to an embodiment of the disclosed technology, when the braid sealing device is partially expanded.
Figure 1B:
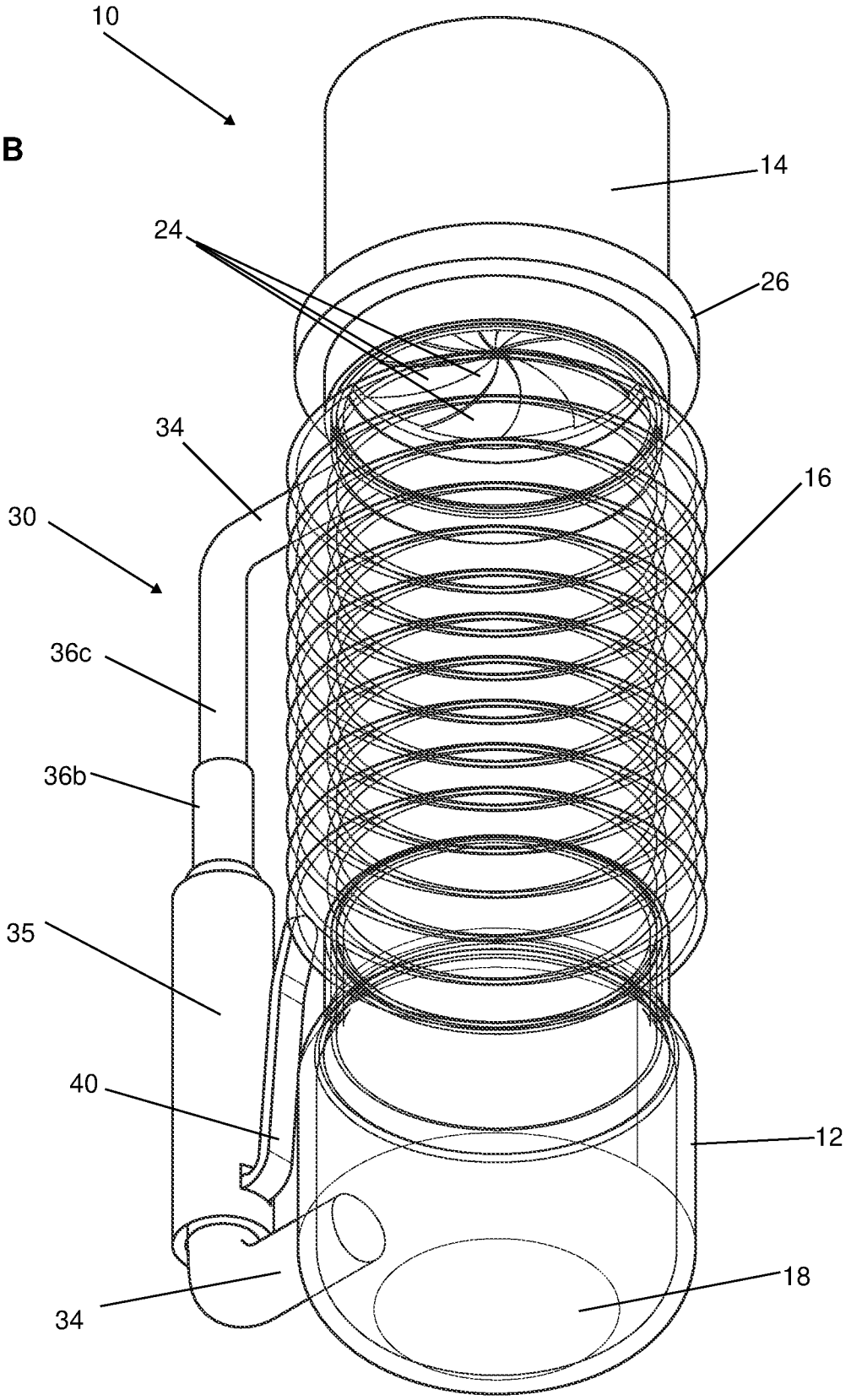
Figure 2A:
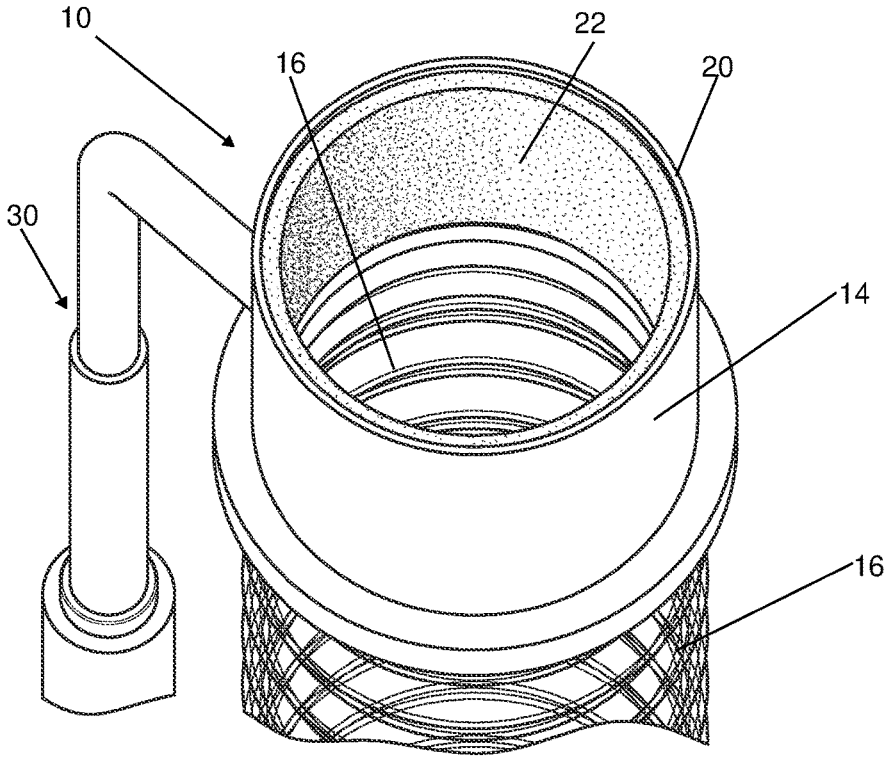
FIGS. 2A and 2B are partial perspective illustrations of the braid-sealing device of FIGS. 1A and 1B, in open and closed configurations, respectively, according to an embodiment of the disclosed technology.
Figure 2B:
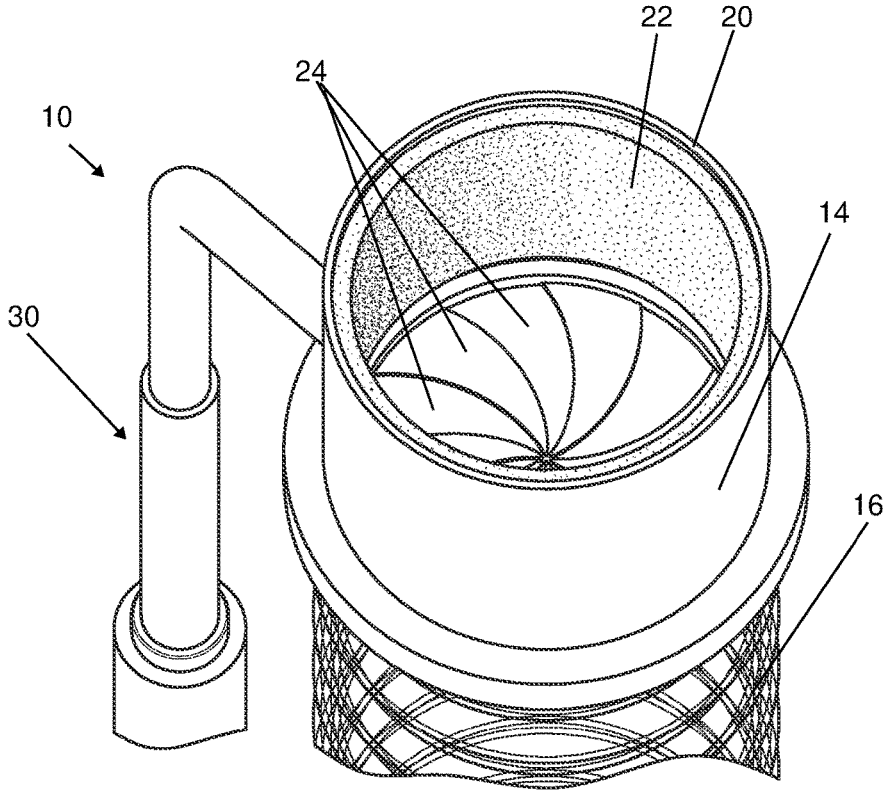

Reference is now made to FIGS. 1A and 1B, which are perspective illustrations of a braid-sealing device 10 according to an embodiment of the disclosed technology, when the braid sealing device is partially expanded. Reference is additionally made to FIGS. 2A and 2B, which are partial perspective illustrations of the braid-sealing device 10, in open and closed configurations, respectively, according to an embodiment of the disclosed technology.

As seen, the device 10 is substantially cylindrical, and includes a chamber 12 having a sealed bottom, a neck portion 14, and an extendable portion 16 extending between chamber 12 and neck portion 14. Chamber 12 and neck portion 14 are typically made of a flexible material which is cool on the exterior thereof, even when chamber 12 is filled with hot water. For example, chamber 12 and neck portion 14 may be formed of silicone. Extendable portion 16 may be formed in an accordion shape, similar to the folding area of a foldable straw, and is typically formed of a flexible material.

In some embodiments, a base 18 of chamber 12 includes a heating mechanism adapted to be mounted onto a power base (not explicitly shown) and to heat the interior of chamber 12, in a similar manner to the heating of water in an electric kettle. In some other embodiments, activation of the heating mechanism within base 18 does not require a power base. In some such embodiments, device 10 may include a power supply, or may be connectable to a power source, for activation of the heating element to heat water disposed within chamber 12.

A portal 20, allowing flow of fluid into device 10, is disposed at an upper end of neck portion 14. In some embodiments, neck portion 14 is flexible, and is lined with an absorbent material 22, such as terry cloth. In such embodiments, neck portion 14 may be squeezed around the braid as it is being removed from device 10, so as to remove excess water from the braid.

In some embodiments, a mechanism for selectively closing device 10 is disposed at, or near, a lower end of neck portion 14. As seen in FIGS. 1B, 2A, and 2B, the mechanism includes a plurality of segments 24, which are adapted to be disposed within or against a wall of neck portion 14 while the device is open, as shown in FIG. 2A. To close device 10, segments 24 may be rotated to extend from the wall of neck portion 14 into the hollow of the device, thereby closing the device, as shown in FIG. 2B. In some embodiments, closing of the device, or rotation of segments 24, may be carried out by rotation of a dial 26, or other suitable mechanism, disposed about neck portion 14. In other embodiments, device 10 may include a button or lever actuator adapted to rotate segments 24, for opening and/or closing of the device. As explained in further detail hereinbelow, segments 24 may be closed about the braid during sealing thereof in hot water, so as to prevent hot water or steam from exiting the device during the sealing. This helps prevent burns and other types of injuries of the patron and the hairstylist. It is to be appreciated that segments 24 may be replaced by any other suitable type of closing mechanism that can be selectively used to open device 10 or to close the device, possibly about a braid.

As seen in FIGS. 1A and 1B, a handle 30 connects chamber 12 and neck portion 14, around extendable portion 16. Handle 30 includes a first substantially horizontal segment 32 connected to chamber 12, and a second substantially horizontal segment 34 connected to neck portion 14. The longitudinal portion of handle 30, connecting segments 32 and 34, comprises a user engageable base segment 35, having multiple telescoping segments 36*a*, 36*b*, and 36*c*, disposed therein, the telescoping segments being adapted to fit one inside the other in a telescoping manner. In the illustrated embodiment, user engageable base segment 35 is connected to, or integrally formed with, first horizontal segment 32, whereas telescoping segment 36*c* has the smallest circumference and is connected to, or integrally formed with, second horizontal segment 34. Telescoping segments 36*a* to 36*c* facilitate extension of handle 30 to match extension of extendable portion 16. In FIGS. 1A and 1B, handle 30 is partially extended, such that telescoping segment 36*c* is fully extended out of telescoping segment 36*b*, telescoping segment 36*b* is partially extended out of telescoping segment 36*a*, and telescoping segment 36*a* is fully disposed within base segment 35.

A lever 40 is disposed in user engageable base segment 35 of handle 30. In some embodiments, lever 40 may be functionally associated with telescoping segments 36*a* to 36*c*, such that activation of the lever may extend or shorten handle 30 by extraction or retraction of one or more of the telescoping segments. In some embodiments, lever 40 may be functionally associated with segments 24, or with the mechanism for closing device 10, such that activation of the lever may cause segments 24 to rotate so as to close the device or to open it. In some embodiments, device 10 may include multiple levers 40, each used for a different function. In some other embodiments, device 10 may include a single lever, which may be activated in different planes, or manners, to accomplish different things. For example, depression of lever 40 toward handle 30 may cause retraction of telescoping segments 36*a* to 36*c*, whereas extension of lever 40 away from handle 30 may cause extension of the telescoping segments. As another example, rotation of lever 40 in one direction, relative to handle 30, may cause rotation of segments 24 toward the center of device 10 to close the device, whereas rotation of lever 40 in the opposing direction may cause opening of the device by rotation of segments 24 toward the wall of device 10 to open the device.

Figure 3A:
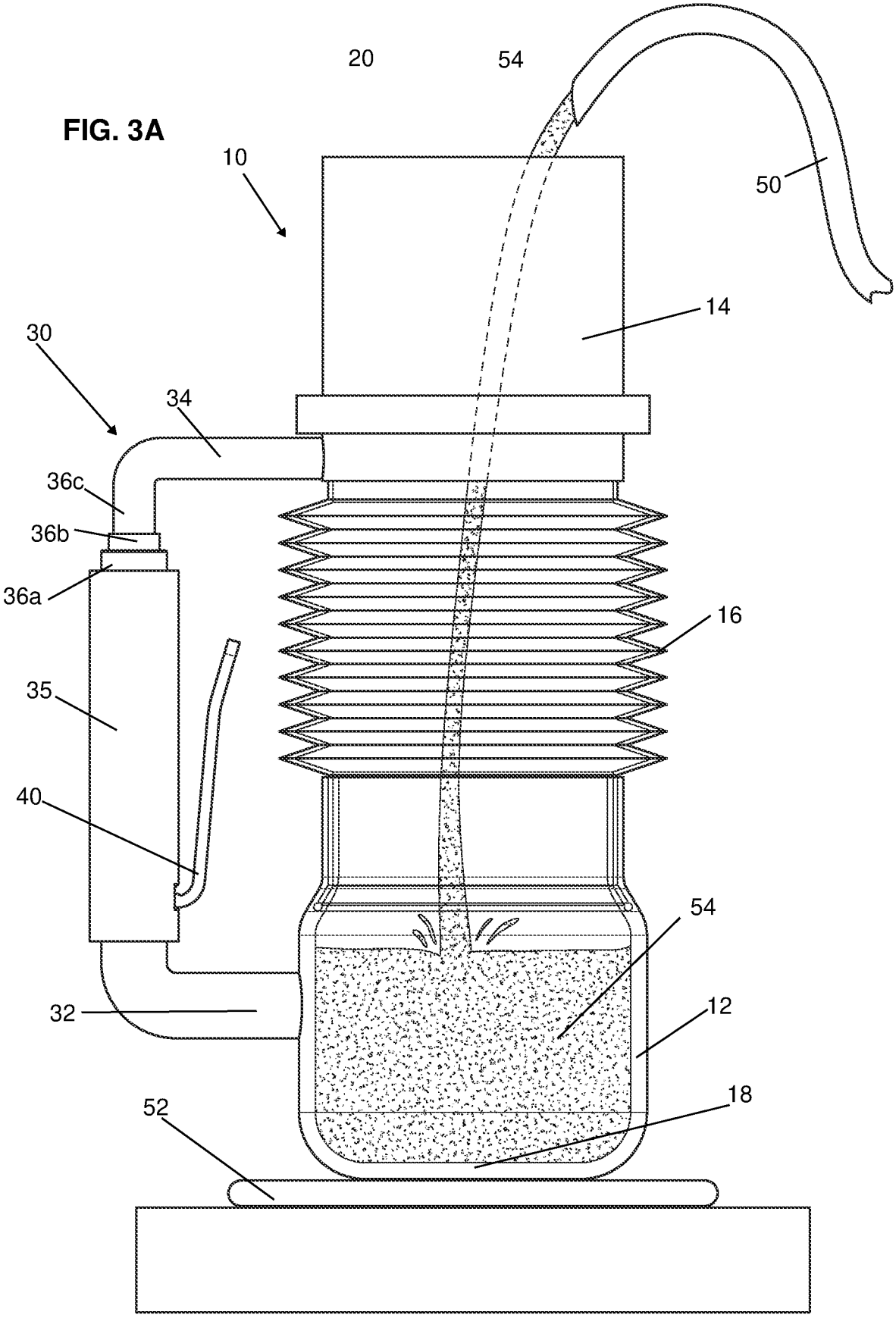
FIGS. 3A, 3B, and 3C are schematic illustrations of a method of using the braid-sealing device of FIGS. 1A to 2B to seal a braid, according to an embodiment of the disclosed technology.
Figure 3B:
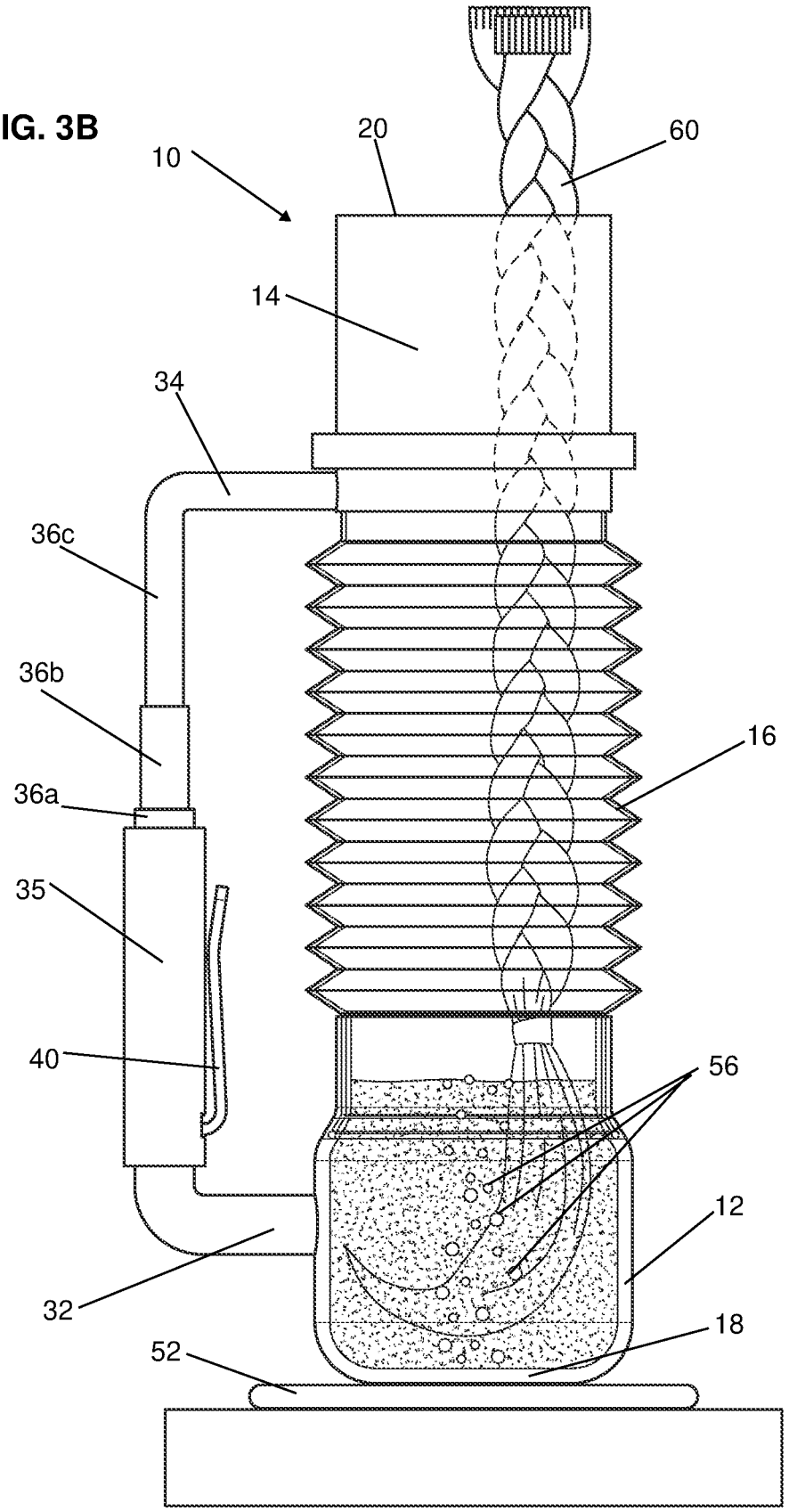
Figure 3C:
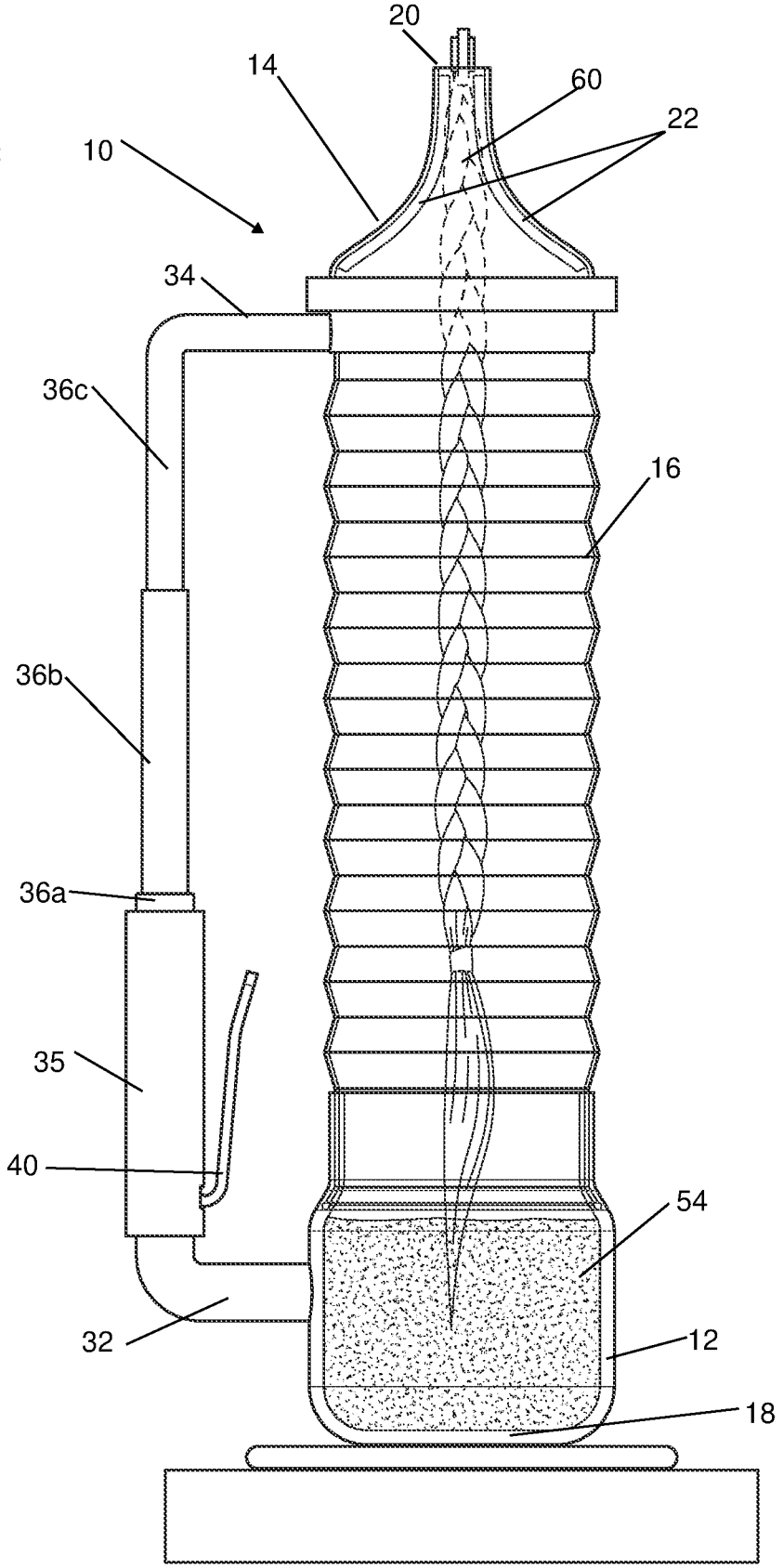

Reference is now made to FIGS. 3A, 3B, and 3C, which are schematic illustrations of steps of a method of using braid-sealing device 10 to seal a braid, according to an embodiment of the disclosed technology.

As seen in FIG. 3A, initially, device 10 is in its most compressed form, with extendable portion 16 being fully compressed, and telescoping segments 36*a* to 36*c* being disposed within user engageable base segment 35. Device 10 is open (i.e. segments 24 are disposed in or against the wall of neck portion 14), and water is poured into device 10 from a water source 50, which may be a faucet or a hose. Typically, cold water is poured into the device, thereby preventing injuries from the person filling the device.

Device 10 may be placed on a power base 52, similar to the base of an electrical kettle, so as to provide power for the heating mechanism in base 18 to heat water 54 within device 10.

Turning to FIG. 3B, water 54 has boiled, as indicated by bubbles 56. A synthetic braid 60 is inserted into device 10 via portal 20, such that at least a portion of the braid is disposed within water 54. In some embodiments, such as when the synthetic braid is detached from the head of a wearer, or salon patron, this step may be carried out while device 10 is on power plate 52. In other embodiments, such as ones in which the braid is attached to the patron's head, device 10 may be removed from power plate 52 when the braid is inserted thereinto. In such embodiments, the hair may include synthetic hair and/or natural human hair.

Depending on the length of braid 60 being sealed, the length of device 10 may be extended to accommodate most, or all, of the braid. Extending the length of the device may be accomplished by extending the length of extendable part 16, and correspondingly extending the length of handle 30 by extracting at least some of the telescoping segments from each other. In the embodiment illustrated in FIG. 3B, telescoping segment 36*c* is fully extracted from telescoping segment 36*b*, and telescoping segment 36*b* is partially extracted from telescoping segment 36*a*. As seen, handle 30 is not extended to its maximal length, because telescoping segment 36*a* is still disposed within base segment 35.

In some embodiments, following insertion of braid 60 into device 10, the opening of the device is closed, to prevent hot water from splashing out of device 10, and to prevent, or minimize, exposure to steam of the person (or people) sealing the braid and/or of the wearer of the braid (in embodiments in which the sealing takes place when the braid is worn). Closing of device 10 may be accomplished, for example, by closing of segments 24 about braid 60. In some embodiments, lever 40 may be activated in order to rotate segments 24 from their open position, in or against the wall of neck portion 14, to their closed position. For example, in the illustrated embodiment, comparison of FIGS. 3A and 3B shows that in FIG. 3B lever 40 has been depressed toward handle 30, so as to close the segments 24 (shown clearly in FIG. 2B) about braid 60.

In some embodiments, following closing of device 10, the device is squeezed, for example by squeezing chamber 12 and/or extendable portion 16, so as to spread boiling water 54 along the length of braid 60.

Turning now to FIG. 3C, it is seen that water 54 is allowed to cool down, and device 10 is further extended, for example to accommodate the entire length of braid 60. As seen, the extension of device 10 is accomplished by further extension of extendable portion 16 and corresponding extraction of telescopic segment 36*b* out of telescopic segment 36*a*. Typically, device 10 is opened by moving segments 24 to their open position (see FIGS. 2A and 2B), for example by releasing the depression of lever 40.

Neck portion 14 is compressed about braid 60, such that absorbent material 22 of the neck portion absorbs excess water from the braid, as the braid is being removed from device 10, via portal 20. Slow removal of braid 60, while engaging the braid with absorbent material 22, not only absorbs or removes excess water, but also allows time for the braid to cool, thus preventing the need to further cool the braid after drying thereof.

In some embodiments, the method as described herein may be used to soften braids or other vertical hairstyles, and/or to achieve a straighter texture of hair forming the braids. This is particularly true with respect to vertical hairstyles including, or formed of, natural human hair.

In some embodiments, the system, device, and method described herein may be used for sanitizing tools, e.g. hair cutting tools such as shears, clippers, trimmers, razors, and/or blades thereof. In such embodiments, the tool may be inserted into chamber 12 and surrounded by boiling water, or by sanitizing liquid, for sanitizing thereof.

In some embodiments, the system, device, and method described herein may be used to dye hair, particularly natural hair, for example in a vertical hairstyle. In such embodiments, the liquid disposed in chamber 12 may be a hair dye, such that inserting hair into device 10 and spreading the liquid over the hair would result in dyeing of the hair.

It is to be appreciated that the device of the disclosed technology overcomes the deficiencies of the prior art, by enabling a single person (hairstylist) to seal braids, while reducing the risk of injury of the hairstylist and the patron whose braids are being sealed. Additionally, the device of the disclosed technology maximizes the water removal from the braid, as well as the circumference of braids being sealed.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods and apparatuses described hereinabove are also contemplated and within the scope of the invention.

The invention claimed is:

1. A method of sealing a vertical hairstyle, the method comprising:

providing a hair-sealing device comprising:

a chamber having a heating element disposed in a bottom surface of the chamber;

an extendable portion extending from and connected to an upper end of the chamber opposite the bottom surface, the extendable portion having an accordion shape and being extendable between a fully compressed state and a fully extended state;

a neck portion extending from an upper end of the extendable portion, the neck portion defining a portal into the device at an upper end thereof and a closure mechanism at a lower end thereof proximate the extendable portion, wherein the closure mechanism defines an open state permitting fluid flow between the neck portion and the extendable portion and a closed state preventing fluid flow between the neck portion and the extendable portion;

a liquid-absorbent material at least partially lining an inner surface of the neck portion and disposed between the portal and the closure mechanism;

wherein the chamber, extendable portion and neck portion are each con-structed of a flexible material;

inserting water into the chamber via the portal with the closure mechanism in an open position;

heating the water in the chamber by activation of the heating element to achieve boiling;

inserting the vertical hairstyle into the device, via through the portal, such that the vertical hairstyle is in contact with the heated water;

closing the closure mechanism about the vertical hairstyle to prevent or minimize hot water and/or steam from exiting the device via the portal;

after the closing the closure mechanism, squeezing the chamber and/or the extendable portion to spread the heated water along the length of the vertical hairstyle; and after the squeezing the chamber and/or extendable portion, removing the vertical hairstyle from the chamber via the neck portion and the portal, and during, the removing, squeezing the neck portion to engage the absorbent material with the vertical hairstyle to absorb excess fluid from the vertical hairstyle.

2. The method of claim 1, wherein the chamber is formed of a material having has low heat conductivity, the method further comprising holding an exterior of the chamber, during or immediately following the heating of the liquid water disposed therein.

3. The method of claim 1, wherein the vertical hairstyle includes synthetic hair strands.

4. A method of softening and straightening braids, the method comprising:

providing a hair-treating device comprising:

a chamber having a base, a cylindrical wall extending from the base and a heating mechanism incorporated into the base;

an extendable portion extending from and connected to an upper end of the chamber opposite the bottom surface, the extendable portion having an accordion shape and being extendable between a fully compressed state and a fully extended state;

a neck portion defining a portal into the device at an upper end thereof, the neck portion having a closure mechanism at a lower end thereof and the extendable portion;

a liquid-absorbent material at least partially lining an inner surface of the neck portion and disposed between the portal and the closure mechanism; and an extendable handle having a first handle segment connected to the chamber, a second handle segment connected to the neck portion and a longitudinal handle portion extending between the first and second handle segments where the length of the longitudinal handle portion is adjustable to correspond with adjust-ment of the length of the extendable portion, wherein the chamber, extendable portion and neck portion are each con-structed of a flexible material;

inserting a liquid into the chamber via the portal with the closure mechanism in an open position;

heating the liquid in the chamber by activation of the heating mechanism;

inserting the braid into the device, via the portal, such that the braid is in contact with the heated liquid;

closing the closure mechanism about the braid to prevent or minimize the heated liquid and/or steam from exiting the device via the portal;

after the closing the closure mechanism, squeezing the chamber and/or the extendable portion to spread the heated liquid along the length of the braid; and after the squeezing the chamber and/or extendable portion, removing the braid from the chamber via the neck portion and the portal, and during, the removing, squeezing the neck portion to engage the absorbent material with the braid to absorb excess liquid from the braid.

5. The method of claim 4, wherein the flexible material of the neck portion and the chamber has low heat conductivity, such that an exterior surface of the neck portion and an exterior surface of the chamber remain cool to the touch of a human hand when the liquid in the chamber is boiling.

6. The method of claim 4, wherein the heating mechanism is adapted to heat a liquid disposed in the chamber, and is adapted to draw power from a power plate, when the hair-treating device is disposed on the power plate.

7. The method of claim 4, wherein the longitudinal handle portion comprises a plurality of telescoping segments.

* * * * *